US006325251B1

(12) United States Patent
Santos

(10) Patent No.: US 6,325,251 B1
(45) Date of Patent: Dec. 4, 2001

(54) COMBINATION FUEL TANK AND TOOL HOLDER APPARATUS

(76) Inventor: Robert J. Santos, Professional Tree Service, 1198 Whitney Ave., Napa, CA (US) 94559

( * ) Notice: Subject to any disclaimer, the term of this patent is extended or adjusted under 35 U.S.C. 154(b) by 0 days.

(21) Appl. No.: 09/698,015

(22) Filed: Oct. 30, 2000

Related U.S. Application Data

(60) Provisional application No. 60/166,738, filed on Nov. 22, 1999.

(51) Int. Cl.[7] ..... B67D 5/06

(52) U.S. Cl. ..... 222/192; 222/135; 222/465.1; 222/530; 220/555; 220/735

(58) Field of Search ..... 222/135, 192, 222/465.1, 129, 530, 538; 220/567.2, 23.8, 503, 555, 735; 150/154; 206/372, 373

(56) References Cited

U.S. PATENT DOCUMENTS

| | | | | |
|---|---|---|---|---|
| D. 250,747 | | 1/1979 | Mollico | D9/175 |
| D. 251,772 | | 5/1979 | Ernst et al. | D9/175 |
| D. 270,330 | | 8/1983 | Bolen | D9/337 |
| D. 333,177 | | 2/1993 | Poirier | D23/202 |
| D. 346,113 | | 4/1994 | Ferguson et al. | D9/347 |
| D. 355,115 | | 2/1995 | Chrisco | D9/337 |
| 1,804,731 | * | 5/1931 | Albertine | 222/530 |
| 1,837,719 | | 12/1931 | Larson | 92/3 |
| 2,788,919 | | 4/1957 | Bostwick | 222/129 |
| 3,154,219 | | 10/1964 | Dean et al. | 222/129 |
| 4,274,556 | | 6/1981 | Thiessen | 222/135 |
| 4,416,396 | | 11/1983 | Ward | 222/129 |
| 4,881,652 | | 11/1989 | Schiemann | 220/20 |
| 4,889,255 | | 12/1989 | Schiemann | 220/83 |
| 4,972,972 | * | 11/1990 | Goguen | 222/530 |
| 5,772,066 | * | 6/1998 | Reynolds | 220/735 |
| 5,971,200 | * | 10/1999 | Reynolds | 220/735 |
| 6,068,163 | * | 5/2000 | Kihm | 222/530 |
| 6,189,697 | * | 2/2001 | Davis | 206/373 |

* cited by examiner

*Primary Examiner*—Kevin Shaver
*Assistant Examiner*—Patrick Buechner
(74) *Attorney, Agent, or Firm*—Richard C. Litman

(57) ABSTRACT

A combination fuel tank and tool holder apparatus having dual fuel compartments for gasoline and oil and hand pumps. Holders for chain saw tools such as a saw wedge, chip brush, saw files, and a screwdriver and socket wrench combination are provided on three sides of the plastic apparatus in a first embodiment. In a second embodiment, the fuel tank lacks external holders, which holders are on a canvas cover with apertures on top for the handle and hand pumps. The holders are lined with polyvinyl inserts.

6 Claims, 4 Drawing Sheets

COMBINATION FUEL TANK AND TOOL HOLDER APPARATUS

CROSS-REFERENCE TO RELATED APPLICATION

This application claims the benefit of U.S. Provisional Patent application Ser. No. 60/166,738, filed Nov. 22, 1999.

BACKGROUND OF THE INVENTION

1. Field of the Invention

The present invention relates generally to a combination fuel tank and tool holder apparatus. More specifically, a first embodiment of the the invention has dual plastic fuel compartments for gasoline and oil dispensible by hand pumps. Holders for a gas pump and chain saw tools are provided on the sides of the plastic apparatus. In a second embodiment, the fuel tank is devoid of the recited holders, but an open topped canvas cover with a gas pump holder and tool holders or sleeves lined with polyvinyl inserts are provided.

2. Description of Related Art

The related art of interest describes various dual fuel tanks and dispensers, but none disclose the addition of dual pumps and tool holders on the gas and oil tank combination and the use of a canvas cover with sleeves and a pocket for tools for a dual fuel tank for maintaining a chain saw. The related art will be discussed in the order of perceived relevance to the present invention.

U.S. Pat. No. 4,274,556 issued on Jun. 23, 1981, to Eldon D. Thiessen describes a dual dispensing container for supplying a chain saw. The squeeze bulbs and their associated locking plunger mechanisms for the dispenser tubes and the chamber volumes for the gasoline and lubricating oil are identical. A handle joins the filler necks. A retaining notch and projection adjacent each filler neck holds the dispenser tube. A check valve must be located proximate to the end of each filler tube to prevent dripping. The squeeze bulbs are immobilized in cavities on the top surface of the container. The dual dispensing container is distinguishable for lacking means for storing pertinent tools and utilizing identical liquid volume capacities and pumping control mechanisms.

U.S. Pat. No. 4,416,396 issued on Nov. 22, 1983, to Jackson G. Ward describes a portable fuel and oil dispensing (by gravity) container made of plastic for a chain saw resting on a tripod of foot long legs. The tanks are separated by an empty space with a depression and an offset handle on top. Each tank has a filler cap, a pressure release venting valve and a fuel flow cap to permit draining of the fluids from the bottom through hoses several feet long. An open-topped compartment is positioned on three sides. On the top of the oil tank three open-topped bins are provided. The fuel capacity is 2–4 gallons. The oil capacity is 2–4 quarts. The container is distinguishable for requiring gravity feed of its liquids and legs.

U.S. Design Pat. No. 250,747 issued on Jan. 9, 1979, to Roxie Mollico describes a combined oil and gasoline container with a covered tool box tray positioned on a side and proximate to the top of the container. Each tank has a filler cap and a squeeze bulb on a flexible hose having a wire brace. An outlet hose on the bulb is held by a bracket for each tank on opposite sides of the container. A handle is provided on top of the container. The combination container is distinguishable for requiring two squeeze bulbs to dispense the oil and the gasoline.

U.S. Design Pat. No. 270,330 issued on Aug. 30, 1983, to Ralph A. Bolen describes a dual liquid storage and dispensing container having a rectangular configuration with an offset handle. Brackets at each of the handle support brackets with wing nuts to hold the flexible hoses for each liquid. A circular cover for each hose has a stud for apparently revolving the cover to permit flow of the liquid by gravity when tipping the container. The dual liquid storage and dispensing container is distinguishable for its unique dispensing structure.

U.S. Pat. No. 4,881,652 issued on Nov. 21, 1989, to Wolfram Schiemann describes a dual-chamber can made of plastic. A 5 liter gasoline container is joined by a 5 mm. connecting member to a 2.5 liter oil container. A handle is integral with the top portions of both chambers. Each chamber has its own threaded neck. The bottoms of the chambers have corrugated surfaces. The oil container has a vertical tool holder for attaching a screwdriver as best shown in U.S. Pat. No. 4,889,255 issued on Dec. 26, 1989, to the same inventor. The dual-chamber cans are distinguishable for their unique structure and the lack of any pumping apparatus.

U.S. Design Pat. No. 251,772 issued on May 8, 1979, to Frederick T. Ernst et al. describes a dual compartment fuel container for a chain saw having equal volumes for the fuel combined at one end by fasteners. The handle is formed by joining each half from the joined compartments. Each compartment has an inflexible and rotatable spout which can be pivoted to tuck into the base of the handle. The dual compartment fuel container is distinguishable for its combined structure and pivoting inflexible spouts.

U.S. Design Pat. No. 333,177 issued on Feb. 9, 1993, to Michel Poirier describes a combined gasoline and oil container having a large gasoline container with a handle and vent cap joined to a smaller oil container. Both containers have filling caps and a shape with an enlarged base. The combined container is distinguishable for its unique shape.

U.S. Design Pat. No. 346,113 issued on Apr. 19, 1994, to John Ferguson et al. describes a dual gasoline container comprising two joined containers of unequal size having individual filling caps. The hollow handle has a vent cap and is positioned only over the larger containers. The container is distinguishable for its simple structure for carrying only gasoline.

None of the above inventions and patents, taken either singly or in combination, is seen to describe the instant invention as claimed.

SUMMARY OF THE INVENTION

The present invention is directed to a combination fuel tank and tool holder apparatus made by injection molding having dual fuel compartments for gasoline and oil dispensible by hand pumps. Holders for chain saw tools such as a saw wedge, chip brush, saw files, and a screwdriver and socket wrench combination are provided on three sides of the plastic apparatus.

Accordingly, it is a principal object of the invention to provide a combination dual fuel tank and tool holder apparatus.

It is another object of the invention to provide a combination dual fuel tank with separate tanks for gasoline and lubrication oil.

It is a further object of the invention to provide a combination dual fuel tank with hand pumps for the carried fuels.

Still another object of the invention is to provide a plastic combination dual fuel tank with holders for the pumps and for chain saw maintenance tools on the outside as a first embodiment and an open topped canvas cover with tool holders for a dual fuel tank without external integrated tool holders as a seocnd embodiment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
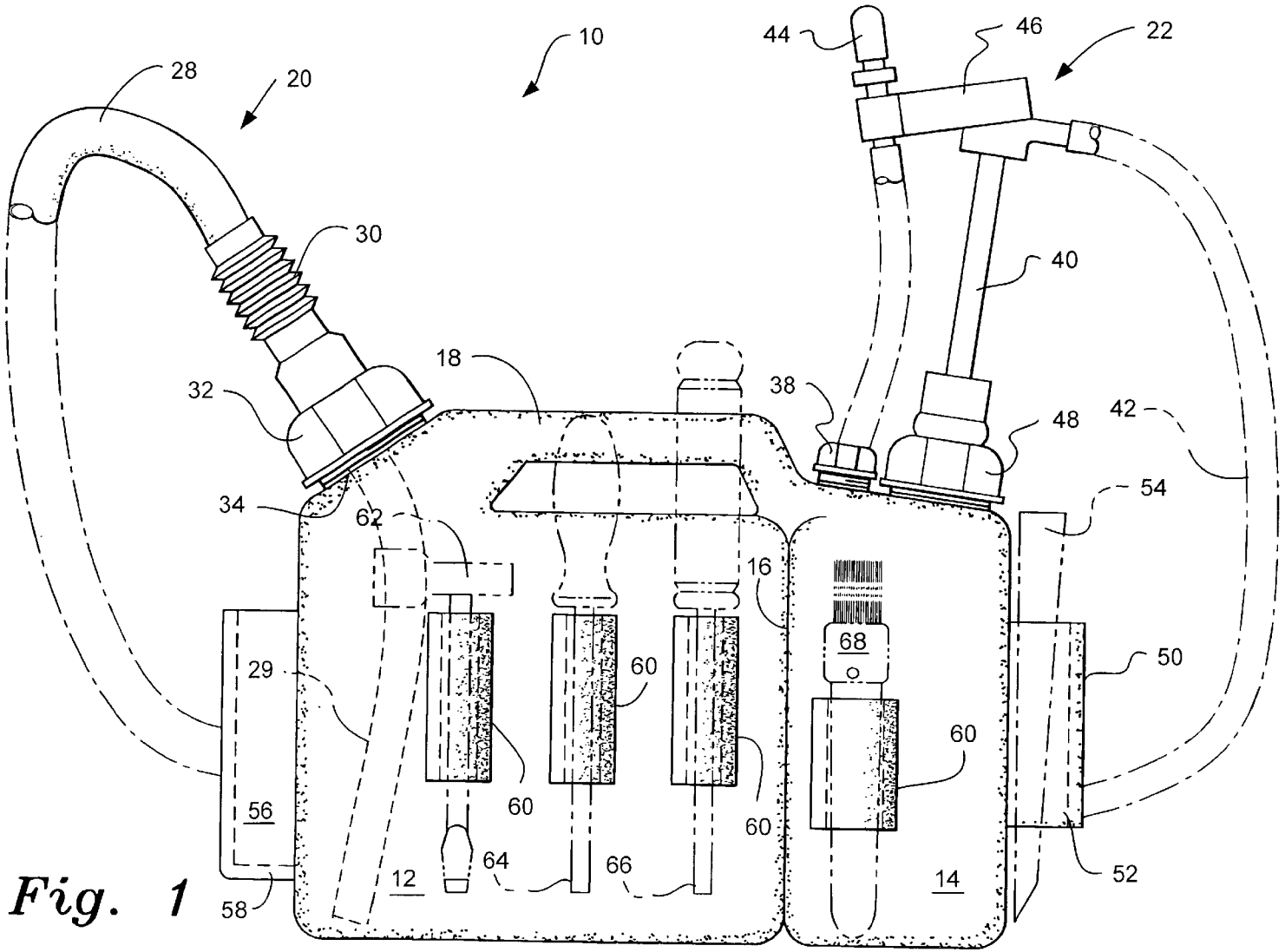
FIG. 1 is a front elevational view of a combination fuel tank and tool holder apparatus holding chain saw maintenance tools according to a first embodiment of the present invention.
Figure 2:
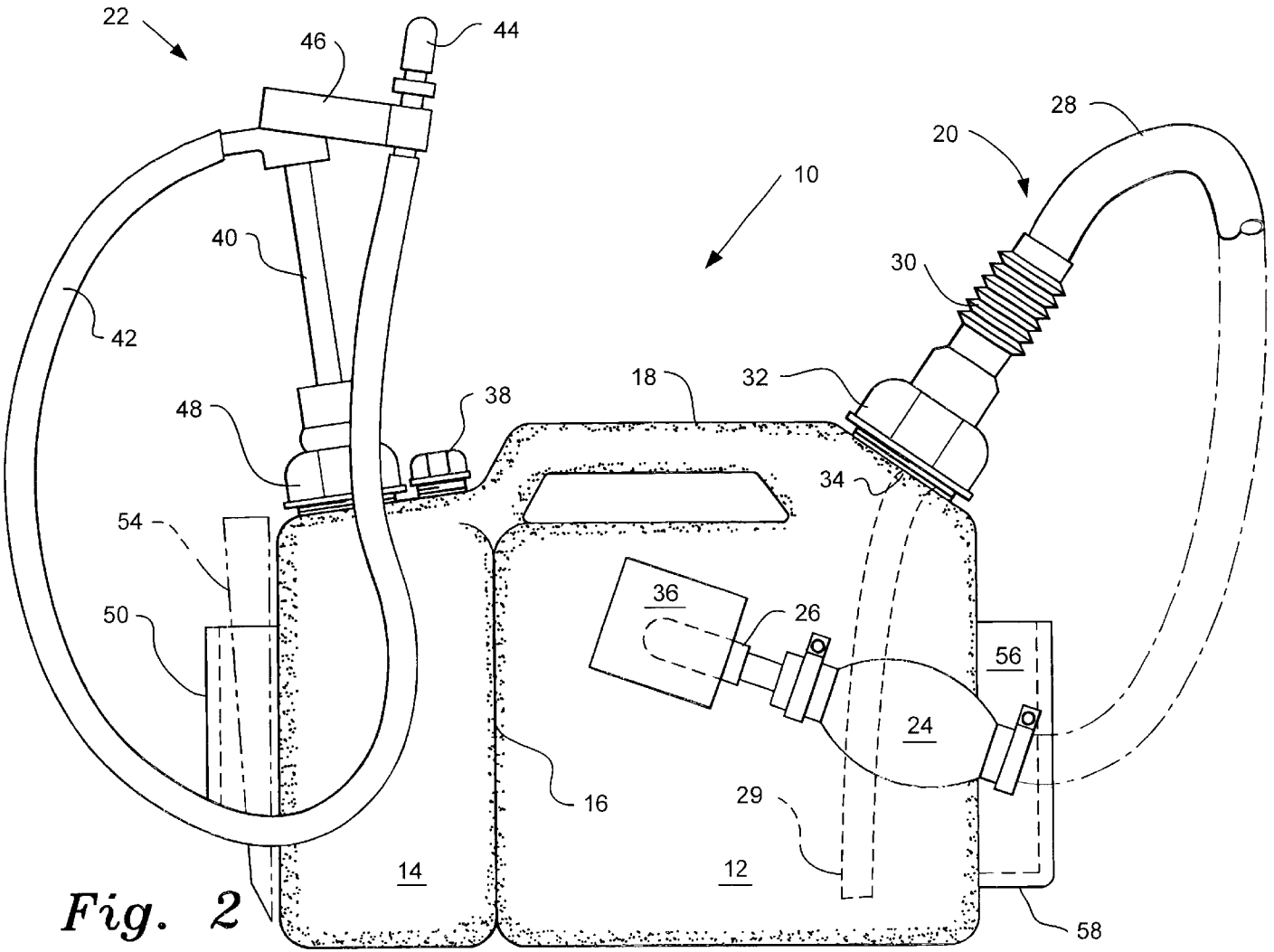
FIG. 2 is a rear elevational view of the FIG. 1 apparatus.

The present invention is directed to a first embodiment depicted in FIGS. 1 and 2 of a combination dual fuel tank and tool holder apparatus 10 made of plastic by an injection molding process for use with a chain saw (not shown). A gasoline tank portion 12 and a lubricating oil tank portion 14 are formed contiguous to each other with a common wall 16. The apparatus or chain saw accessory 10 has a hollow centered top handle 18, a gasoline pump 20 and an oil pump 22 on top. The gasoline pump 20 has a bulb 24 squeezable for dispensing gasoline from a nozzle 26. The outside gasoline hose 28 has a corrugated section 30 to accommodate bending proximate its base connection 32 to the inclined surface 34 of the gasoline tank 12. The outside gasoline hose 28 continues into the gasoline tank 12 as an inside gasoline hose 29 to touch the bottom. A gasoline pump holder 36 is conveniently located in an inclined position on a wide side of the gasoline tank 12 for holding the bulb 24. A gasoline venting cap 38 is offset and the conduit to the gasoline tank 12 is conveniently located in the hollow handle 18.

A hand push pump 40 for vertical pumping of the lubrication oil is connected by a hose 42 to a nozzle 44 which can be stored on a notched handle 46 of the oil pump 40. The oil pump has a base connection 48.

In FIG. 1, a large accessory pocket 50 with an open bottom 52 is located on the right-hand narrow side of the apparatus 10 to hold a chain saw wedge 54. The opposite narrow side has a large accessory pocket 56 with a closed bottom portion 58. A plurality of tubular holders 60 with open ends are vertically positioned on a wide side of the apparatus 10 opposite the side having the gasoline pump holder 36. The four holders 60 can store, respectively from left to right, a combination socket wrench and flat head screwdriver tool 62, a cylindrical coarse saw file 64, a cylindrical fine saw file 66, and a chip brush 68.

An exemplary volume capacity for the apparatus 10 comprises a gasoline capacity of 2.5 gallons and a lubricating oil capacity of 1 gallon.

Figure 3:
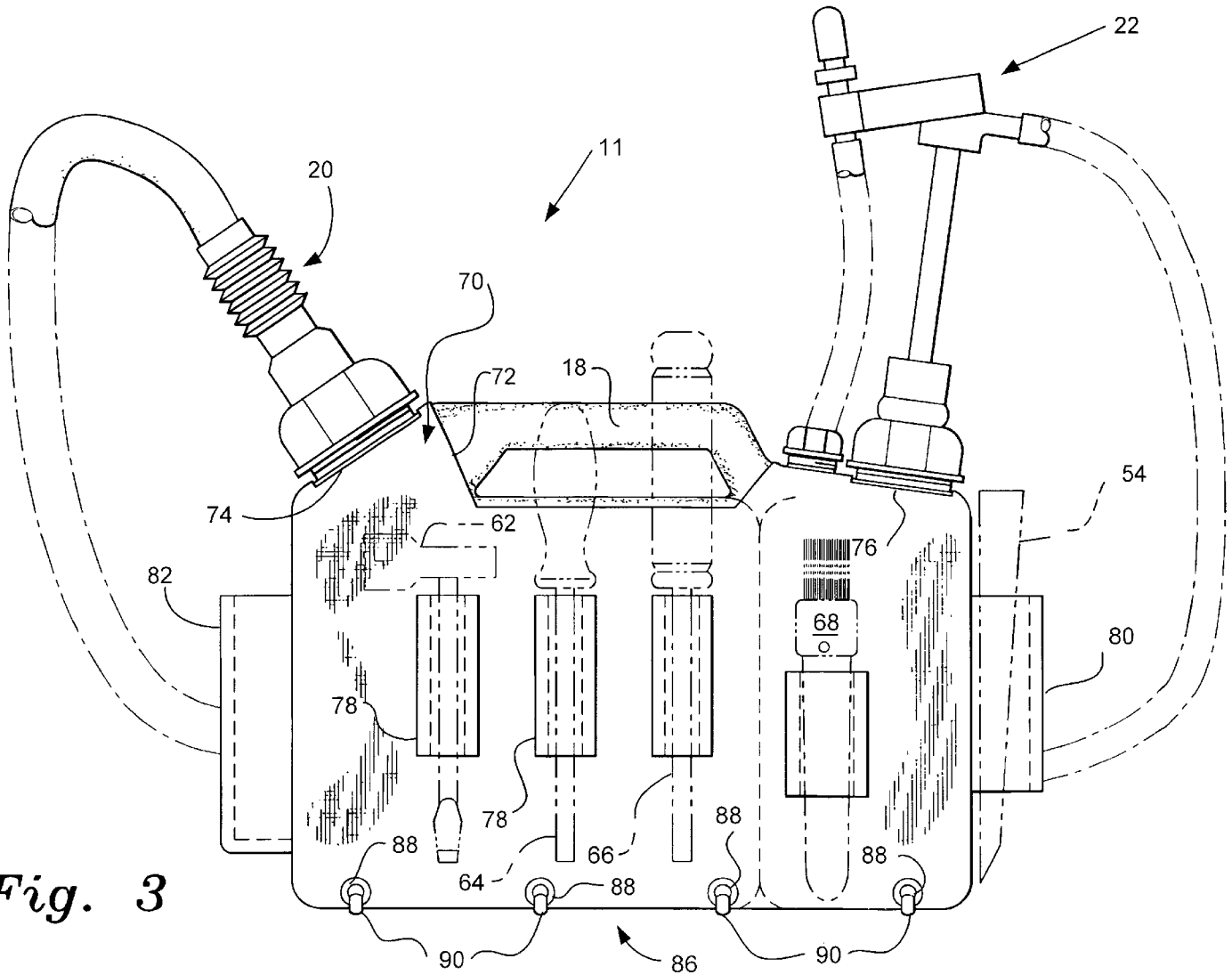
FIG. 3 is a front elevational view of a tool holder cover for a combination fuel tank apparatus as a second embodiment of the present invention.
Figure 4:
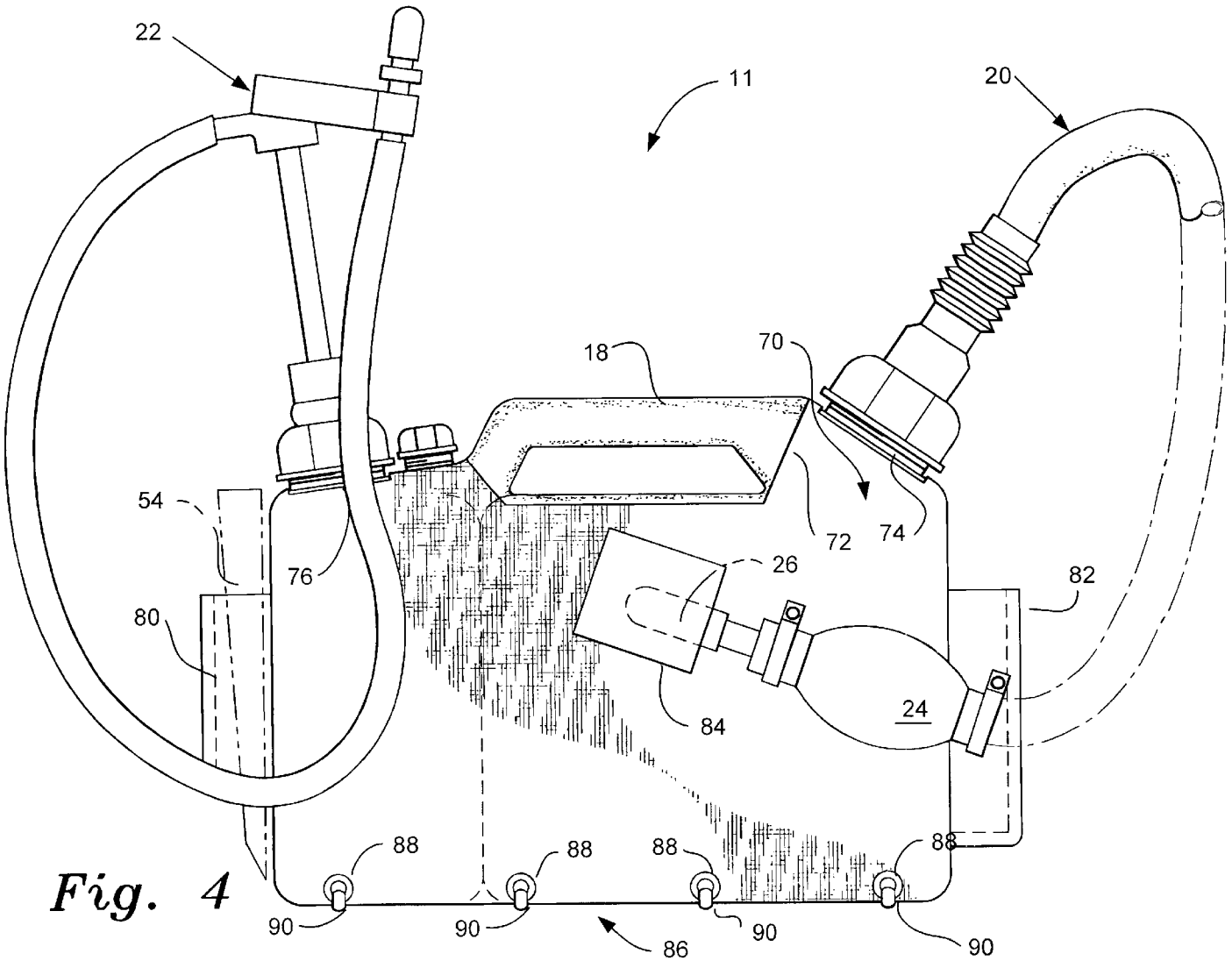
FIG. 4 is a rear elevational view of a tool holder cover of the FIG. 3 apparatus.

Turning to the second embodiment 11 of the present invention illustrated in FIGS. 3 and 4, a canvas cover 70 having three open top portions 72, 74 and 76 for the handle 18, gas pump 20 and the oil pump 22, respectively, are shown. The canvas cover 70 has an open bottom portion 86 with grommets 88 and hook and loop fasteners 90. The combination fuel tank in this embodiment does not have any external integrated tool holders except for the notched oil nozzle holder handle 46. Tools 62 (wrench and screwdriver combination), 64 (coarse saw file), 66 (fine saw file), and 68 (chip brush) are shown in shadow held in canvas sleeves 78 lined with polyvinyl chloride (PVC) inserts. The chain saw wedge 54 and any accessory tools can be held in side pockets 80 (open bottom) and 82 (closed bottom), respectively, made of the same materials. In FIG. 4, the gas pump nozzle 26 and bulb 24 are held by an inclined sleeve 84 with a PVC insert.

Thus, an economical combination chain saw accessory apparatus has been shown which conveniently carries the rudimentary tools, gasoline and lubricating oil required to maintain a chain saw in the field.

It is to be understood that the present invention is not limited to the embodiments described above, but encompasses any and all embodiments within the scope of the following claims.

I claim:

1. A plastic combination dual fuel containing tank and tool holder apparatus comprising:

a plastic contiguous gasoline tank and a lubricating oil tank having a centered horizontal top handle and a flat bottom;

a pump bulb squeezable for dispensing gasoline, distally extending from the top of the tank via an outside hose configured as a corrugated proximate portion, and a distal dispensing end nozzle cooperating for storage in an inclined holder which is inclined relative to the flat bottom on a wide side of the gasoline tank, said outside hose extending inside the gasoline tank to touch the bottom thereof;

a hand pump for vertical pumping of the lubrication oil being connected to a hose ending in a distal dispensing end nozzle cooperating for storage on a handle of the hand pump;

an accessory pocket located on a narrow side of the apparatus opposite a vertically positioned tubular holder for holding an accessory tool on an opposite narrow side; and a plurality of tubular holders vertically positioned on a wide side opposite the wide side having the gasoline pump holder for holding the shanks of various chain saw accessory tools.

2. The combination apparatus according to claim 1, wherein the gasoline capacity is approximately 2.5 gallons, and the lubricating oil capacity is approximately 1 gallon.

3. A plastic combination dual fuel containing tank apparatus and canvas tool holder cover comprising:

a plastic contiguous gasoline tank and a lubricating oil tank having a centered horizontal top handle, opposite wide sides, opposite narrow sides, and a flat bottom;

a canvas cover for said contiguous tanks with four openings on top for the handle, air vent and dispensers for the gasoline and lubricating oil, and an open bottom with a plurality of grommets tied together with hook and loop fasteners;

a pump bulb squeezable for dispensing gasoline, distally extending from the top of the tank via an outside hose with a corrugated proximate portion and a distal dispensing end nozzle cooperating for storage in an inclined holder on the canvas cover on a wide side of the gasoline tank, said inclined holder being inclined relative to the flat tank bottom, and said outside hose extending inside the gasoline tank to touch the bottom thereof;

a hand pump for vertical pumping of the lubrication oil being connected to a hose ending in a distal dispensing end nozzle cooperating for storage on a handle of the hand pump;

an accessory pocket located on a narrow side of the apparatus cover opposite a vertically positioned sleeve for holding an accessory tool on an opposite narrow side of the cover;

a plurality of sleeves vertically positioned on a wide side opposite the wide side having the gasoline pump holder for holding the shanks of various chain saw accessory tools; and said sleeves, inclined holder and accessory pocket being formed of canvas lined with polyvinyl chloride inserts.

4. The combination apparatus according to claim 3, wherein the gasoline capacity is approximately 2.5 gallons, and the lubricating oil capacity is approximately 1 gallon.

5. A canvas tool holder cover for a plastic dual fuel containing tank having a handle and two dispensers comprising:

a partial canvas cover for a rectangular plastic dual fuel containing tank having opposite wide sides, opposite narrow sides, a flat bottom, and a centered horizontal top handle;

said cover having four openings on top for said handle, a dispenser on one side of the handle, and a dispenser and a fuel vent cap on an opposite side;

said cover having a side pocket on each said opposite narrow sides, an inclined sleeve on one wide side inclined relative to the flat bottom, and a plurality of canvass sleeves on an opposite wide side;

said cover having an open bottom and a plurality of grommets on a bottom edge; and straps inserted in said grommets and having hooks and loop fasteners.

6. The canvas tool holder cover according to claim 5, wherein said sleeves, inclined holder and accessory pocket being formed of canvas lined with polyvinyl chloride inserts.

* * * * *